US005152157A

United States Patent [19]

Lonati

[11] Patent Number: 5,152,157

[45] Date of Patent: Oct. 6, 1992

[54] CIRCULAR KNITTING MACHINE WITH CASTING-OFF SINKER ACTUATION DEVICE

[75] Inventor: Francesco Lonati, Brescia, Italy

[73] Assignee: Lonati S.r.l., Brescia, Italy

[21] Appl. No.: 685,348

[22] Filed: Apr. 15, 1991

[30] Foreign Application Priority Data

Apr. 27, 1990 [IT] Italy ..... 20152 A/90

[51] Int. Cl.[5] ..... D04B 15/24

[52] U.S. Cl. ..... 66/108 R; 66/107

[58] Field of Search ..... 66/107, 108 R

[56] References Cited

U.S. PATENT DOCUMENTS

| | | | |
|---|---|---|---|
| 3,270,527 | 9/1966 | Monday | 66/108 R |
| 3,318,113 | 5/1967 | Nebel | 66/108 R |
| 3,399,551 | 9/1968 | Billi | 66/108 R X |
| 3,703,819 | 11/1972 | Townsend et al. | 66/108 R X |
| 3,783,645 | 1/1974 | Bianchi | 66/108 R |
| 3,844,141 | 10/1974 | Haustein et al. | 66/108 R |
| 4,156,356 | 5/1979 | Holder | 66/108 R |
| 4,571,957 | 2/1986 | Engelfried | 66/45 |
| 4,708,002 | 11/1987 | Lonati | 66/40 |
| 4,712,390 | 12/1987 | Lonati | 66/54 |
| 4,864,833 | 9/1989 | Bini | 66/108 R X |

FOREIGN PATENT DOCUMENTS

| | | | |
|---|---|---|---|
| 0095445 | 11/1983 | European Pat. Off. . | |
| 2856602 | 7/1980 | Fed. Rep. of Germany | 66/54 |

*Primary Examiner*—Werner H. Schroeder
*Assistant Examiner*—John J. Calvert
*Attorney, Agent, or Firm*—Guido Modiano; Albert Josif

[57] ABSTRACT

The machine has a rotatable needle cylinder and a casting-off sinker actuation device including a coaxial sinker ring supporting a cam and an external countercam. The needle cylinder supports a plurality of casting-off sinkers each having a heel which follows a path, extending around the needle cylinder axis, which is partially defined by the cam and the countercam. A pin is connected to the countercam and is engaged by an actuation element associated with the sinker ring and bilaterally engaging the pin. The actuation element is controllably activatable for bilaterally moving the countercam with respect to the needle cylinder along a direction having a radial component, toward or away from the axis of the needle cylinder.

12 Claims, 3 Drawing Sheets

CIRCULAR KNITTING MACHINE WITH CASTING-OFF SINKER ACTUATION DEVICE

BACKGROUND OF THE INVENTION

The present invention relates to a circular knitting machine, particularly of the type for manufacturing socks and stockings, with a casting-off sinker actuation device.

As known, some types of knitting machines, in particular circular single-cylinder machines for manufacturing socks and stockings, have casting-off sinkers which are arranged in radial grooves of a plate-like support which is rigidly associated with the needle cylinder proximate to its upper end.

The casting-off sinkers are offset with respect to the needles, so that each sinker is arranged between two adjacent needles, and are actuated, during the rotation of the needle cylinder about its own axis, with a reciprocating motion along a direction which is radial with respect to the needle cylinder.

More particularly, the sinkers are moved away from the axis of the needle cylinder when the needles, after taking hold of the thread, begin their descent so as to facilitate the forming of new loops which rest on the upper portion of the sinkers, which is usually planar and is termed "casting-off plane", whereas the previously formed loops are cast off. After casting off the old loops, while the needles begin a new ascent, the sinkers are moved toward the axis of the needle cylinder so as to engage the new loops with a beak which is arranged above the casting-off plane, so as to tense and retain the loops against the stem of the needles.

The movement of the casting-off sinkers in a radial direction with respect to the needle cylinder is obtained by means of an inner annular cam and at least one outer countercam which are associated with a sinker ring which is arranged above the plate-like support. The annular cam and the countercam extend around the needle cylinder and define a path with portions which move toward the needle cylinder axis and portions which move away therefrom; this path is followed by a sinker heel, which protrudes upward from the plate-like support, when the needle cylinder is actuated with a rotary motion about its own axis.

In sock and stocking manufacture, the need to be able to vary the stroke of the sinkers according to the density of the knitting and to the elasticity of the thread is particularly felt.

In loose knitting, i.e. knitting with long loops, and/or with highly elastic threads, it is in fact convenient for the sinkers to be able to approach more closely the needle cylinder axis, in order to adequately tense the loops being formed, with respect to tight knitting, i.e. knitting with short loops, and/or with scarcely elastic threads for which an excessive advancement of the sinkers toward the needle cylinder axis would cause damage and breakage of the loops.

In order to satisfy this requirement, in some types of machines the countercam or countercams can yield outward in contrast with return springs. In this manner, with highly elastic threads and/or with long loops, the springs keep the countercam in the position which is closest to the inner cam, achieving a closer approach of the sinkers to the needle cylinder axis, whereas with short loops and/or with scarcely elastic threads the resistance of the knitting causes the yielding of the springs and therefore a partial outward movement of the countercam, thus avoiding an excessive approach of the sinkers to the needle cylinder axis.

However, the use of springs in order to limit the tensing of the loops has some disadvantages.

For some types of thread in some kinds of knitting, the springs employed can in fact be excessively rigid or excessively yielding with respect to the results to be obtained.

Furthermore, in machines which can reach high needle cylinder rotation rates, the centrifugal force which acts on the sinkers causes the yielding of the springs and therefore an outward spacing of the countercam or countercams, with the consequence of significantly reducing or completely eliminating the return of the sinkers toward the needle cylinder axis.

On the other hand, the use of more rigid springs can cause damage to the knitting being formed when the needle cylinder operates at low rotation rates.

SUMMARY OF THE INVENTION

The aim of the present invention is to solve the problems described above by providing a circular knitting machine, particularly of the type for manufacturing socks and stockings, with a casting-off sinker actuation device which allows to vary the tension exerted by the sinkers on the loops of knitting according to the thread being used and according to the knitting conditions.

Within the scope of this aim, an object of the invention is to provide a machine with a sinker actuation device which ensures the adequate tensing of the knitting being formed even with high needle cylinder rotation rates.

Another object of the invention is to provide a machine wherein the tensing performed by the sinkers can be varied without requiring interventions for disassembling or replacing machine parts.

A further object of the invention is to provide a sinker actuation device which is simple to manufacture.

This aim, these objects and others which will become apparent hereinafter are achieved by a circular knitting machine, particularly of the type for manufacturing socks and stockings, with a casting-off sinker actuation device, which comprises a sinker ring arranged coaxially to the needle cylinder proximate to its upper end and supports at least one cam and at least one countercam, said countercam being arranged outside said cam with respect to the needle cylinder axis, said cam and said countercam defining at least one portion of a path which extends around the needle cylinder axis for a heel of the casting-off sinkers, which are supported by the needle cylinder which can rotate about its axis with respect to said sinker ring, characterized in that it comprises positioning means which are associated with said sinker ring and which can be controllably actuated in order to adjust the position of said countercam along a direction having a radial component with respect to the needle cylinder.

BRIEF DESCRIPTION OF THE DRAWINGS

Further characteristics and advantages of the invention will become apparent from the description of a preferred but not exclusive embodiment of the machine according to the invention, illustrated only by way of non-limitative example in the accompanying drawings, wherein.

DESCRIPTION OF THE PREFERRED EMBODIMENTS

Figure 1:
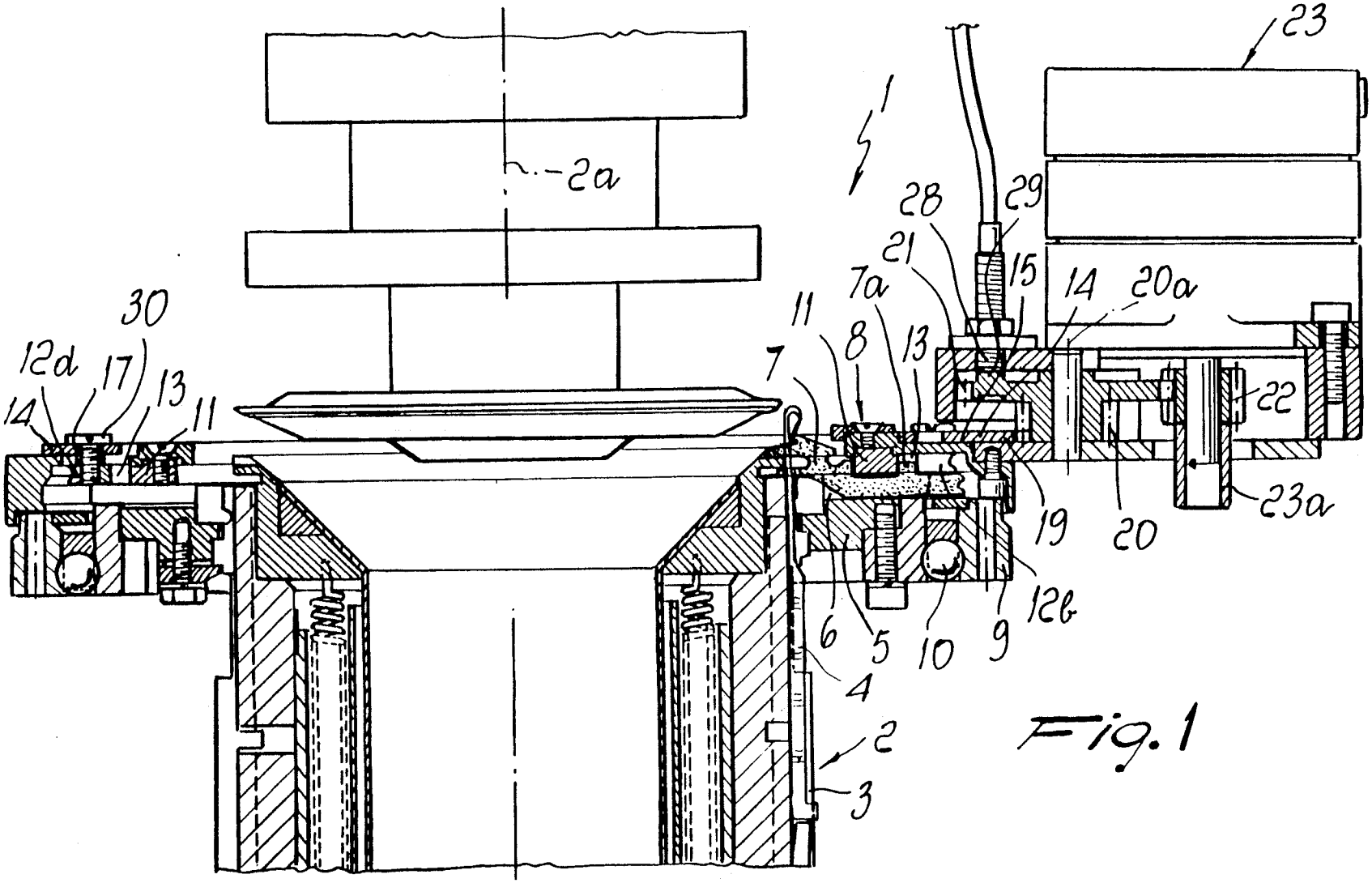
FIG. 1 is a schematic axial sectional side elevation view of the machine according to the invention, illustrating the upper end of the needle cylinder.
Figure 2:
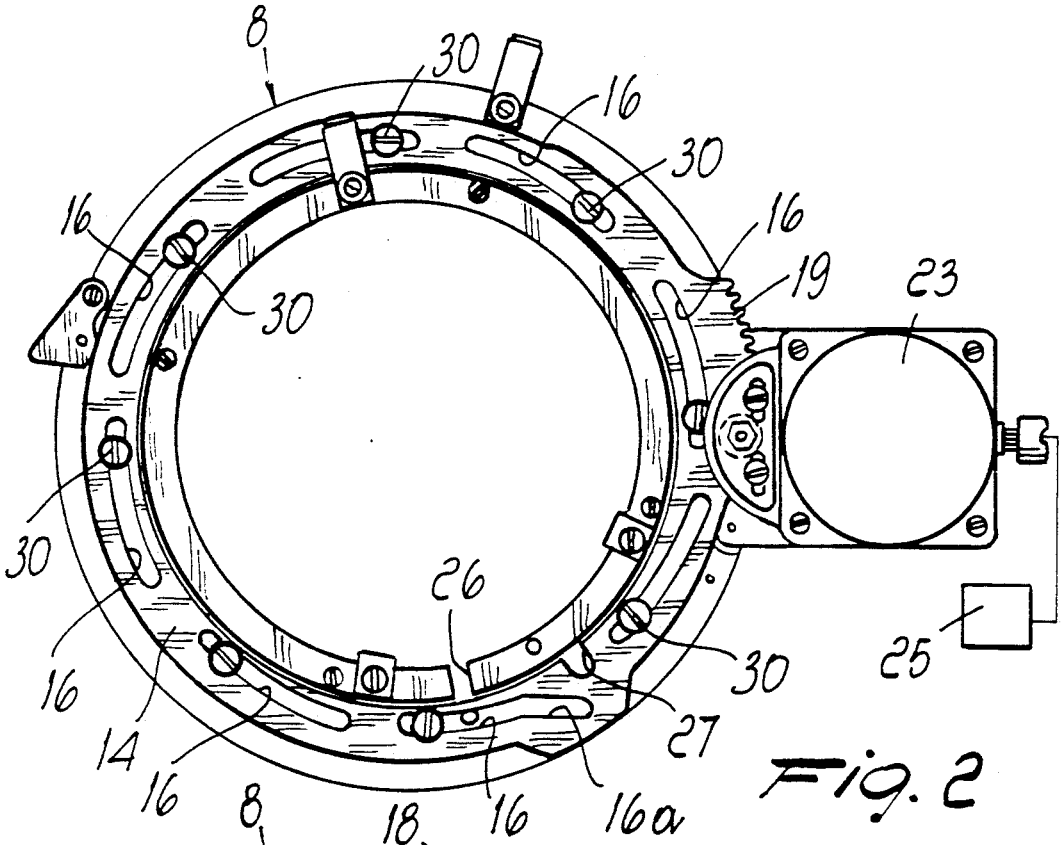
FIG. 2 is a top plan view of a sinker ring of the machine according to the invention.
Figure 3:
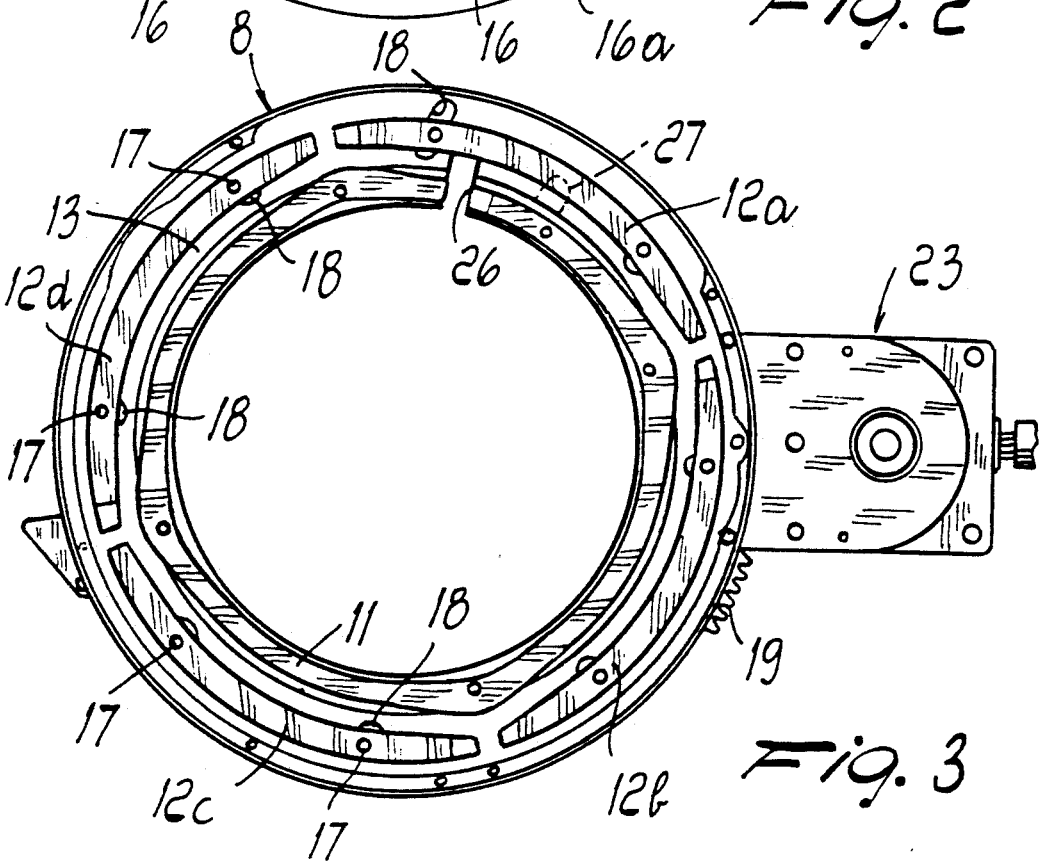
FIG. 3 is a bottom plan view of the sinker ring.

With reference to the above figures, the machine according to the invention, generally indicated by the reference numeral 1, comprises, like known machines, a needle cylinder 2 with an axis 2*a* which is arranged vertically and with a skirt in which a plurality of axial grooves 3, each accommodating a needle 4, is defined.

A plate-like support 5 is arranged proximate to the upper end of the needle cylinder 2 and is rigidly associated coaxially to the needle cylinder 2. A plurality of radial grooves 6 is defined in the plate-like support 5, and each groove accommodates a casting-off sinker 7 which can be actuated with a reciprocating motion along the related radial groove 6. The radial grooves 6 are offset with respect to the axial grooves 3 of the needle cylinder so that each sinker 7 is arranged between two adjacent needles.

Each sinker 7 has a heel 7*a* which protrudes upward from the related radial groove, and a sinker ring 8 is mounted above the plate-like support 5.

More particularly, an outer ring 9 is arranged around the plate-like support 5 and is associated therewith by interposing a bearing 10, so that the needle cylinder 2, together with the plate-like support 5, can rotate, by means of appropriate rotation means, about the axis 2*a* with respect to the outer ring 9.

The sinker ring 8 is fixed to the outer ring 9 and is arranged coaxially to the needle cylinder 2.

The lower face of the sinker ring 8 is provided with a cam 11, which is fixed to the sinker ring and extends around the needle cylinder, and with four countercams 12*a*, 12*b*, 12*c*, 12*d*, which face the side of the cam 11 which is directed outward with respect to the needle cylinder, so that a path 13, in which the heels 7*a* of the sinkers engage, is defined between the cam 11 and the countercams.

The path 13 extends around the needle cylinder and is shaped substantially in a known manner with portions which move toward the needle cylinder axis 2*a* and portions which move away therefrom in order to obtain a reciprocating motion of the sinkers 7 along radial directions with respect to the needle cylinder when said needle cylinder is actuated with a rotary motion about its axis 2*a* with respect to the sinker ring.

According to the invention, positioning means are provided and can be controllably actuated in order to adjust the countercams along a direction which has a radial component with respect to the needle cylinder.

Said positioning means comprise an actuation element 14 which is shaped substantially like an annulus and is arranged coaxially to the needle cylinder on the upper face of the sinker ring 8.

The actuation element 14 is arranged coaxially to the needle cylinder and is partially accommodated, so that it can rotate about the axis 2*a*, in an annulus-shaped seat 15 defined on the upper face of the sinker ring 8.

Slots 16 are defined in the actuation element 14 and are circumferentially spaced from one another; a pin 17 is slidingly bilaterally engaged in each of said slots, passes through an opening 18 of the sinker ring and is rigidly fixed to one of the countercams. More particularly, each of the countercams is fixed to two pins 17, each of which can slide within a slot 18 and is rigidly associated with the actuation element 14 by means of a screw 30.

Each slot 16 has an eccentric extension with respect to the axis 2*a*, and each opening 18 is elongated along a direction which is substantially radial with respect to the needle cylinder, so that a partial rotation of the actuation element about the axis 2*a* with respect to the sinker ring causes a bilateral movement of the countercams toward or away from the axis 2*a*.

The actuation element 14 has a toothed perimetric portion 19 which is coupled, by means of gearwheels 20, 21, 22, to the output shaft 23*a* of a step motor 23 which is connected to a programmable electronic control unit 25 which supervises the operation of the machine.

The gearwheel 20 meshes with the perimetric portion 19 and is rigidly associated, in its rotation about its axis 20*a*, with the gearwheel 21, which is coaxial thereto and in turn meshes with the gearwheel 22 which is keyed on the output shaft 23*a* of the step motor 23.

In a portion of the sinker ring 8 there is a radial recess 26 which extends starting from the side of the ring 8 which is directed toward the needle cylinder and also affects the cam 11.

A radial recess 27 is similarly defined in a portion of the actuation element 14 and, by means of a partial rotation of said actuation element 14 about the axis 2*a* with respect to the sinker ring 8, can be aligned with the recess 26 so as to allow the manual extraction of a sinker 7 arranged at said recesses in order to replace it if necessary.

The slot 16 which is closest to the recess 27 and within which a pin, which is fixed to the countercam 12*a* extending on the recess 26, engages, has an end portion 16*a* which moves more markedly away, with respect to the remaining part, from the axis 2*a* and is followed by the related pin during the alignment of the recesses 26 and 27 so that the related countercam is moved out of the area occupied by the recesses 26 and 27 in order to facilitate the extraction of the underlying sinker; the opening 18 related to said pin also has an adequate length in a radial direction in order to allow the movement of the related countercam.

Safety means are conveniently provided, which detect the position of the actuation element 14 along its arc of a partial rotation, and which are connected to the electronic control unit 25 in order to cause an interruption of the operation of the machine when the recesses 26 and 27 are aligned, in order to avoid damage to the sinkers.

Said safety means are conveniently constituted by a proximity sensor 28 which is associated with the supporting structure of the step motor 23 and faces a side of the gearwheel 21.

A depressed or raised portion 29, in the shape of a circular sector, is provided on said face of the gearwheel 21 and is arranged and sized so that it faces the proximity sensor 28 while the actuation element defines the arc of rotation which corresponds to the alignment of the recesses 26 and 27.

The operation of the machine according to the invention, as regards the sinker actuation device, is as follows.

Before knitting begins, the electronic control unit 25 acts on the step motor 23 in order to obtain a partial rotation of the actuation element 14 about the axis 2 until the pins 17 are moved at an end of the related slot 16, more specifically at the end opposite to the portion 16*a* of the slot provided with said portion 16*a*. When this position is reached, the step motor 23 is reset, eliminating the remaining steps (FIG. 4).

At this point the machine can start knitting.

Figures 4, 5, 6, 7:
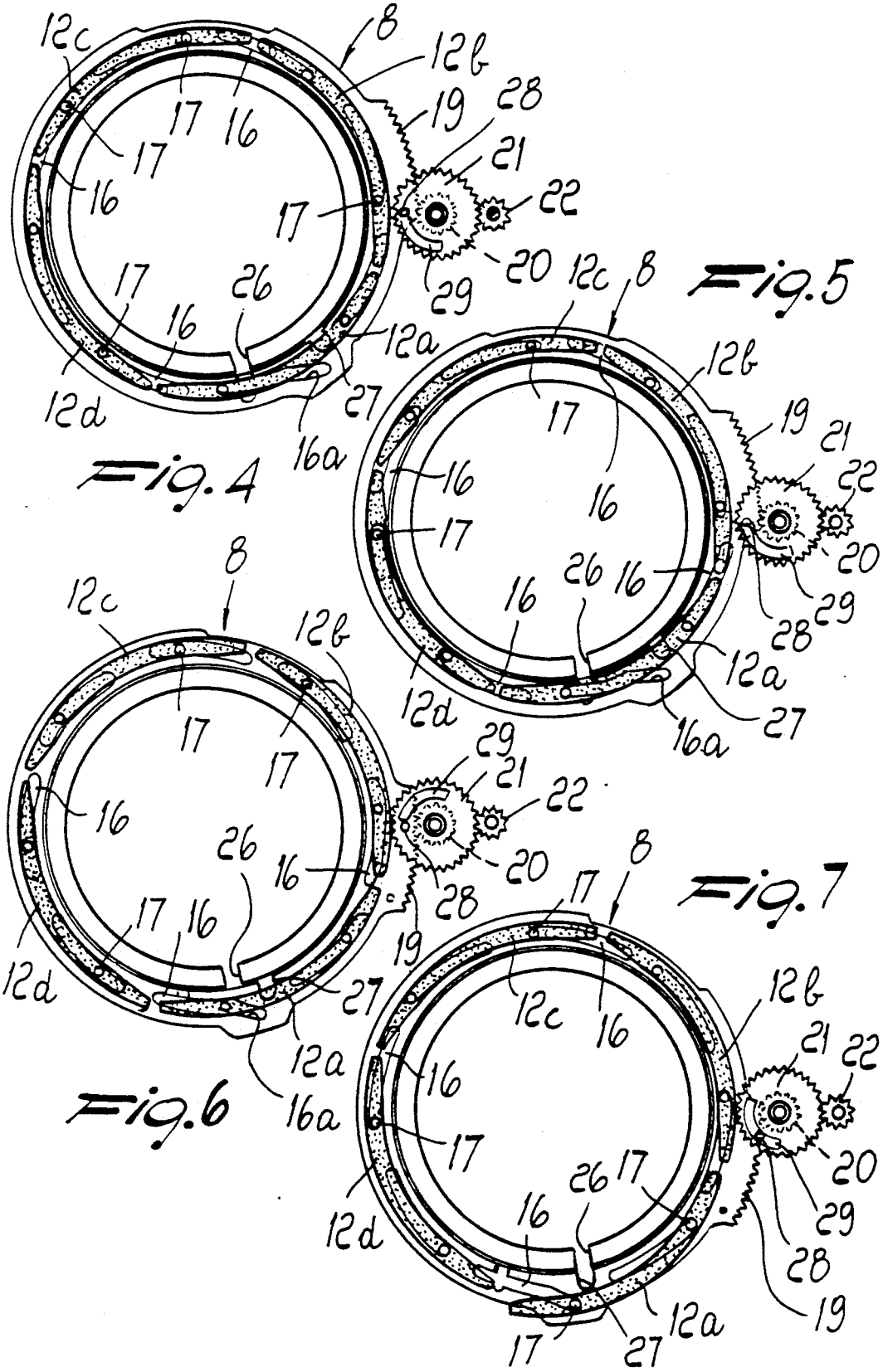
FIGS. 4 to 7 are schematic top plan views of the sinker ring, shown in phantom lines, illustrating its operation.

During knitting, the electronic control unit 25 intervenes, following a preset program, on the step motor 23, which in turn causes the partial rotation of the actuation element 14 in order to vary the distance of the countercams 12*a*, 12*b*, 12*c*, 12*d* from the axis 2*a* (FIGS. 5 and 6).

A variation in the distance of the countercams from the axis 2*a* leads to a variation in the stroke of the casting-off sinkers in their approach toward the axis 2*a*. In this manner, the action of the sinkers on the loops of knitting can be adjusted with extreme precision according to the thread used and to the tightness of the knitting being formed.

The adjustment performed in this manner, besides being extremely precise, cannot be altered even as a consequence of high rotation rates of the needle cylinder.

When it is necessary to replace one or more casting-off sinkers, the electronic control unit 25, following a specific program, slowly rotates the needle cylinder 2 until the sinker to be replaced is moved at the recess 26, and subsequently rotates the actuation element by means of the step motor 23 until the recess 27 is aligned with the recess 26 (FIG. 7).

If, for any reason, during the active operation of the machine the actuation element 14 is rotated until the alignment of the recesses 26 and 27 begins, the control unit 25 automatically halts the machine as a consequence of the sensing performed by the proximity sensor 28 in order to avoid accidental releases of the sinkers from the groove in which they are accommodated.

In practice it has been observed that the machine with the casting-off sinker actuation device according to the invention fully achieves the intended aim since, as it is possible to adjust the distance of the countercams from the needle cylinder axis, it is possible to achieve the precise tensing of the knitting being formed, said tensing being performed by the sinkers with no problems even with high operating speeds and with scarcely elastic threads.

Another advantage of the casting-off sinker actuation device according to the invention is that it allows rapid maintenance interventions for replacing damaged casting-off sinkers.

The machine thus conceived is susceptible to numerous modifications and variations, all of which are within the scope of the inventive concept; all the details may furthermore be replaced with technically equivalent elements.

In practice, the materials employed, as well as the dimensions, may be any according to the requirements and to the state of the art.

I claim:

1. Circular knitting machine, particularly for manufacturing socks and stockings, with casting-off sinker actuation device, comprising a sinker ring arranged coaxially to a needle cylinder proximate to upper end thereof, said sinker ring supporting at least one cam and at least one countercam, said countercam being arranged outside said cam with respect to the needle cylinder axis, said cam and said countercam defining at least one portion of a path which extends around the needle cylinder axis for a heel of casting-off sinkers, said casting-off sinkers being supported by the needle cylinder which can rotate about its own axis with respect to said sinker ring, further comprising positioning means which are associated with said sinker ring and which can be controllably actuated to adjust the position of said countercam along a direction with a radial component with respect to the needle cylinder.

wherein said positioning means comprise an actuation element which is associated with said sinker ring and can be controllably rotated about the needle cylinder axis with respect to said sinker ring, connecting means being interposed between said actuation element and said countercam for the movement of said countercam along said direction with a radial component upon a partial rotation of said actuation element about the needle cylinder axis, and wherein said actuation element is shaped link an annulus and is arranged coaxially to said needle cylinder on the upper face of the sinker ring, at least one slot with an eccentric extension with respect to the needle cylinder axis being defined in said actuation element, a pin engaging in said slot, said pin being rigidly associated with said countercam and passing through an opening which is defined in the upper face of the sinker ring, said opening extending along a direction which has a radial component with respect to the needle cylinder for a movement of said pin along said opening upon the partial rotation of said actuation element with respect to the sinker ring.

2. Machine according to claim 1, wherein said positioning means comprise a step motor which is operatively connected to a programmable electronic control unit of the machine and has its output shaft connected by means of a gear transmission to a perimetric toothed portion of said actuation element.

3. Machine according to claim 1, wherein a radial recess is defined in the upper face of said sinker ring, affects said cam and can be aligned, by means of the partial rotation of said actuation element about the needle cylinder axis, with respect to said sinker ring, with a radial recess which is defined in said actuation element for the removal, through said radial recesses, of the sinkers arranged at said radial recesses, and wherein said countercam can be controllably moved radially out of the space occupied by said radial recesses by means of the partial rotation of said actuation element about the needle cylinder axis with respect to said sinker ring.

4. Machine according to claim 3, further comprising safety means which detect the position of said actuation element along its arc of a partial rotation with respect to the sinker ring, said safety means being operatively connected to said electronic control unit for an interruption of the operation of the machine for the portion of said arc which corresponds to the alignment of said radial recesses.

5. Machine according to claim 3, further comprising safety means which detect the position of said actuation element along its arc of a partial rotation with respect to the sinker ring, said safety means being operatively connected to said electronic control unit for an interruption of the operation of the machine for the portion of said arch which corresponds to the alignment of said radial recesses, and wherein said safety means comprise a proximity sensor which is suitable for sensing a raised or depressed portion which is defined on a face of a gearwheel which meshes with said toothed portion of the actuation element, said raised or depressed portion facing said proximity sensor during the alignment of said radial recesses.

6. Circular knitting machine with casting-off sinker actuation device, particularly for manufacturing stockings, said machine comprising;

a needle cylinder having an upper end and a needle cylinder axis, said needle cylinder being rotatable about said needle cylinder axis;

a sinker ring arranged coaxially to said needle cylinder proximate to said upper end thereof;

at least one cam supported by said sinker ring;

at least one countercam supported by said sinker ring and being arranged externally of said cam with respect to said needle cylinder axis, said countercam being movable along a direction having a radial component with respect to said needle cylinder, toward or away from said needle cylinder axis;

a plurality of casting-off sinkers supported by said needle cylinder and each having at least one heel;

a path for said heel of each of said plurality of casting-off sinkers extending around said needle cylinder axis, at least a portion of said path being defined by said cam and said countercam;

connecting means connected to said countercam;

positioning means associated with said sinker ring and bilaterally engaging said connecting means, said positioning means being controllably activatable for bilaterally moving said countercam back and forth along said direction having a radial component with respect to said needle cylinder.

7. Machine according to claim 6, wherein said positioning means comprise an actuation element, said actuation element being movably mounted on said sinker ring and controllably rotatable about said needle cylinder axis with respect to said sinker ring, said connecting means being bilaterally engaged by said actuation element and being connected to said countercam for causing movement of said countercam towards or away from said needle cylinder axis along said direction having a radial component upon a partial rotation of said actuation element about said needle cylinder axis.

8. Machine according to claim 6, wherein said positioning means comprise an actuation element, said actuation element having an annular shape and being mounted coaxially to said needle cylinder of said sinker ring, at least one slot having an eccentric extension with respect to the needle cylinder axis being defined in said actuation element, and;

wherein said connecting means comprise a pin engaging in said slot, said pin being rigidly associated with said countercam and passing through an opening defined in said sinker ring, said opening extending along a direction which has a radial component with respect to said needle cylinder for causing movement of said pin along said opening upon rotating said actuation element with respect to said sinker ring.

9. Machine according to claim 6, wherein aid sinker ring has an upper face, and wherein aid upper face has formed thereon an annulus shaped seat extending coaxially to said needle cylinder, said positioning means being partially rotatably accommodated in said annulus-shaped seat.

10. Machine according to claim 6, wherein said positioning means comprise;

an actuation element having an annular shape;

a perimetric toothed portion defined by said actuation element;

a step motor having an output shaft and being operatively connected to a programmable electronic control unit, and gear transmission means connecting said step motor to said perimetric toothed portion of said actuation element.

11. Machine according to claim 6, wherein said sinker ring has an upper face, said upper face having defined thereon a radial recess which affects said cam, said positioning means comprising an actuation element, said actuation element having defined therein a recess, said radial recess being alignable with said recess upon partially rotating said actuation element with respect to said sinker ring about said needle cylinder axis, whereby sinkers arranged at said actuation element are removable through said radial recesses and said recess.

12. Machine according to claim 11, wherein said countercam is controllably radially movable away from said radial recesses upon partial rotation of said actuation element with respect to said sinker ring about said needle cylinder axis.

* * * * *